United States Patent [19]

Stout

[11] Patent Number: 4,830,120

[45] Date of Patent: May 16, 1989

[54] METHODS AND APPARATUS FOR PERFORATING A DEVIATED CASING IN A SUBTERRANEAN WELL

[75] Inventor: Gregg W. Stout, Montgomery, Tex.

[73] Assignee: Baker Hughes Incorporated, Houston, Tex.

[21] Appl. No.: 202,383

[22] Filed: Jun. 6, 1988

[51] Int. Cl.[4] ..... E21B 43/118

[52] U.S. Cl. ..... 175/4.51; 166/298

[58] Field of Search ..... 175/4.51, 4.54, 4.6; 166/298, 55, 55.1

[56] References Cited

U.S. PATENT DOCUMENTS 2,414,997 1/1947 Atkins .
4,523,649 6/1985 Stout .
4,637,478 1/1987 George ..... 175/4.54 X

*Primary Examiner*—William P. Neuder

*Attorney, Agent, or Firm*—Hubbard, Thurman, Turner & Tucker

[57] ABSTRACT

Improved method and apparatus are provided for perforating casing located in a deviated portion of a subterranean well. The direction toward which the explosive charges in the downhole perforating gun are facing upon firing of the gun is accurately controlled by a firing head operatively responsive to a first initiating signal activated from the surface and a second signal automatically generated when the gun is rotationally at a predetermined angular position relative to a vertical plane passing through the central axis of the perforating gun. A rotating device within the gun firing head enables the gun to be rotated for generating the second signal when the gun is positioned below a set packer. The technique of the present invention is reliable yet relatively inexpensive, and minimizes undesirable gravitation of formation sands with formation fluids into the casing.

32 Claims, 3 Drawing Sheets

METHODS AND APPARATUS FOR PERFORATING A DEVIATED CASING IN A SUBTERRANEAN WELL

BACKGROUND OF THE INVENTION

1. Field of the Invention

This invention relates to methods and apparatus for perforating a subterranean well and, more particularly, to techniques for accurately controlling the direction toward which the explosive charges of a perforating gun are aimed when fired in a deviated casing of a subterranean well.

2. Background of the Invention

Bore holes drilled into the earth for the purpose of producing oil and gas often intentionally vary from a vertical axis, utilizing techniques generally referred to as slant hole or directional drilling. Recent advances in directional drilling techniques enable the drilling of nearly horizontal boreholes within the hydrocarbon-bearing formation, and these techniques have become widely accepted in the petroleum industry. Directional drilling is frequently used offshore in order to cover a much larger aerial extent of a downhole reservoir from a reduced number of offshore platforms than is possible utilizing vertical drilling techniques. Another advantage of directional drilling is that the well bore exposes a greater cross-sectional area of the reservoir to drainage, and thus results in higher production rates than vertical drilling techniques.

One particular problem encountered when holes are drilled substantially from the vertical in unconsolidated formations is the production of sands or fines which fall into the wellbore from perforations shot vertically upward through the casing. These fines can gravitate into the casing with the formation fluids and trap the perforating gun, resulting in significant workover costs in order to recover the gun and decreasing the life of wellhead equipment. Accordingly, prior art techniques have sought to control the direction in which the perforating charges are facing when the perforating gun is fired in a deviated section of the bore hole, so that all of the perforations are facing substantially downward and fines in the casing are minimized.

One technique for orienting the direction of fire of perforating guns with respect to a vertical plane has relied upon the placement of ears or lugs on the outside of the gun housing at a position which causes the gun to roll over due to an offset center of gravity, and thereby orient the charges downwardly. Although this technique, which is described more fully in U.S. Pat. No. 4,523,649, has met with limited success, it has not fully overcome the problem. Frictional engagement of the perforating gun with the casing may prevent the gun from rotating the charges to the desired downward direction. Attempts have been made to overcome deficiencies by utilizing swivel joints, as described in U.S. Pat. No. 2,414,997, above the perforating charges. However, even with the inclusion of such swivel joints, guns may still be fired in the upward direction, resulting in the migration of fines into the casing and the potential for the gun becoming stuck in the hole.

SUMMARY OF THE INVENTION

Improved methods and apparatus are provided for firing perforating charges of a gun when they have been oriented in the desired direction. More specifically, this invention envisions the placement of shaped charges within a narrow angular pattern on the carrier of the perforating gun. The angular position of the gun within the well casing is determined by a mercury switch, and a circuit to fire the gun is not complete until the charges in the gun are rotationally in their desired position and the mercury in the switch gravitates to allow the completion of the electrical firing circuit. The gun is prevented from unintentionally firing by the inclusion of an initiation switch which can be activated from the surface by various means, including the dropping of a bar down the interior of the tubing, applying hydraulic pressure down the tubing or down the annulus between the casing and the tubing, or sending a signal down an electric line. Once the initiation switch has been activated, the firing circuit can be completed by rotating the gun. The required torque for rotating a long gun or a series of guns is reduced by providing a roller bearing between adjoining ends of gun sections. The roller bearing engages the casing and substantially reduces frictional engagement between the casing and the rotating gun sections.

The gun can be rotated by various techniques. If the gun is positioned in the well under a set packer, an explosive charge in the upper portion of the gun firing head and above a swivel may force a piston down a spiral path. The perforating charges and interconnected lower portion of the firing head are rotationally responsive to rotation of the piston, and will thus be forced to rotate. When the mercury switch responsive to rotation of the perforating charges and positioned below the swivel completes the circuit, the perforating charges will fire in their preselected direction based on their rotational position relative to the mercury switch. If the well is being completed without the use of a packer, it is possible to trip the initiating switch and, if the gun has not fired, rotate the tubing from the surface until the mercury switch is in its downward position, thus completing the circuit and firing the gun.

A primary object of the present invention is to provide a reliable technique whereby a deviated hole can be perforated when the perforating charges are aimed in a desired direction, which is typically downward. A feature of the invention is the utilization of a mercury switch for controlling the firing of a gun relative to a vertical plane passing through the axis of the gun. A further object of this invention is to provide a reliable yet relatively inexpensive technique for rotating a lower portion of a firing head and perforating charges attached thereto when located below a set packer.

These and further features and advantages of the present invention will become apparent from the following detailed description, wherein reference is made to the figures in the accompanying drawings.

DESCRIPTION OF PREFERRED EMBODIMENTS

Figure 1:
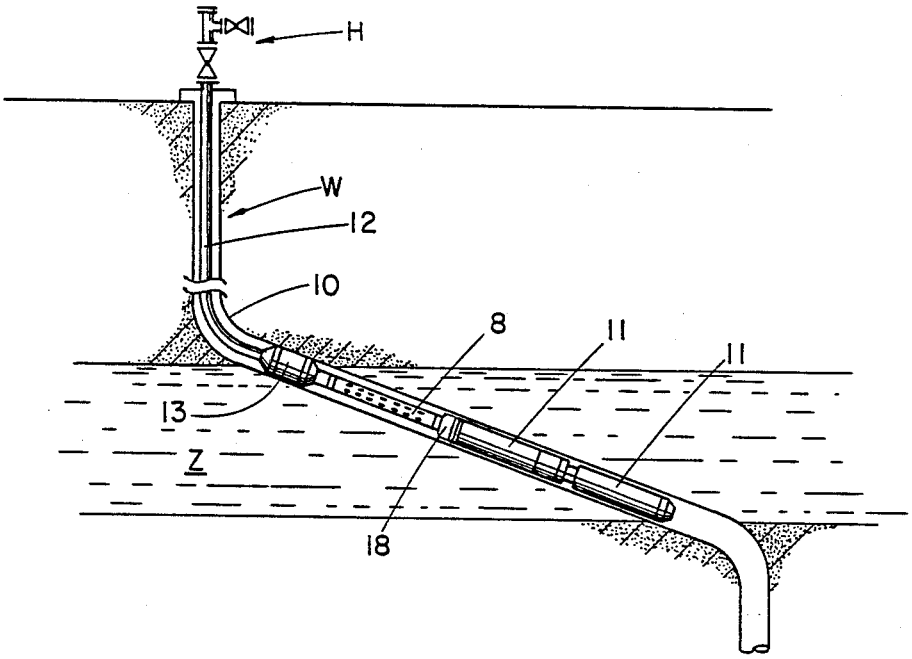
FIG. 1 is a vertical view, partially in cross-section, of a subterranean well and casing wherein the casing passes through a production formation along an inclined axis.

Referring to FIG. 1, a well casing 10 is schematically shown in the installed relationship to a subterranean well W which passes through a production zone Z at an angle to the vertical. As is well known to those skilled in the art, in order to produce fluid from the production zone, the casing 10 adjacent the production zone must be provided with a plurality of perforations. It may be undesirable to produce perforations in a substantially vertical upward direction, in as much as this permits sand and other particulate materials to freely flow or gravitate into the interior of the casing. Accordingly, this invention provides an improved perforating device which is run into the well on tubing or other conduit 12 which extends from the production zone Z to the well head H at the surface.

One or more gun carrier sections 11 each having a plurality of perforating charges, a gun firing head 18, a perforated tubing section 8, and a packer 13 may each be positioned on and lowered into the well by conduit 12. Once the perforating charges are at their desired depth and adjacent the hydrocarbon-bearing formation Z, the packer 13 may be set in conventional fashion to seal the annulus between the casing 10 and the tubing 12. The packer 13 may thereafter remain set until and during perforation of the casing, and during recovery of formation fluids from the formation to the well head H.

Figure 2A:
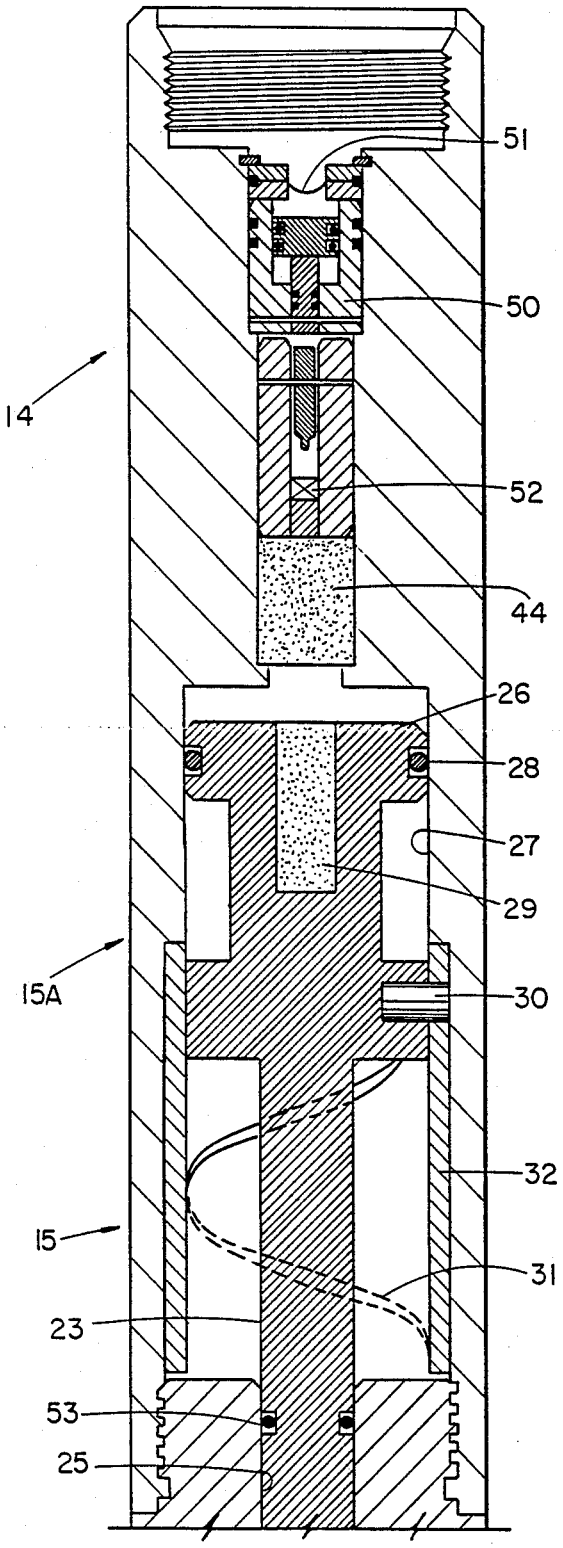
FIGS. 2A and 2B collectively constitute a cross-sectional view of a firing head and a portion of perforating gun according to this invention.
Figure 2B:
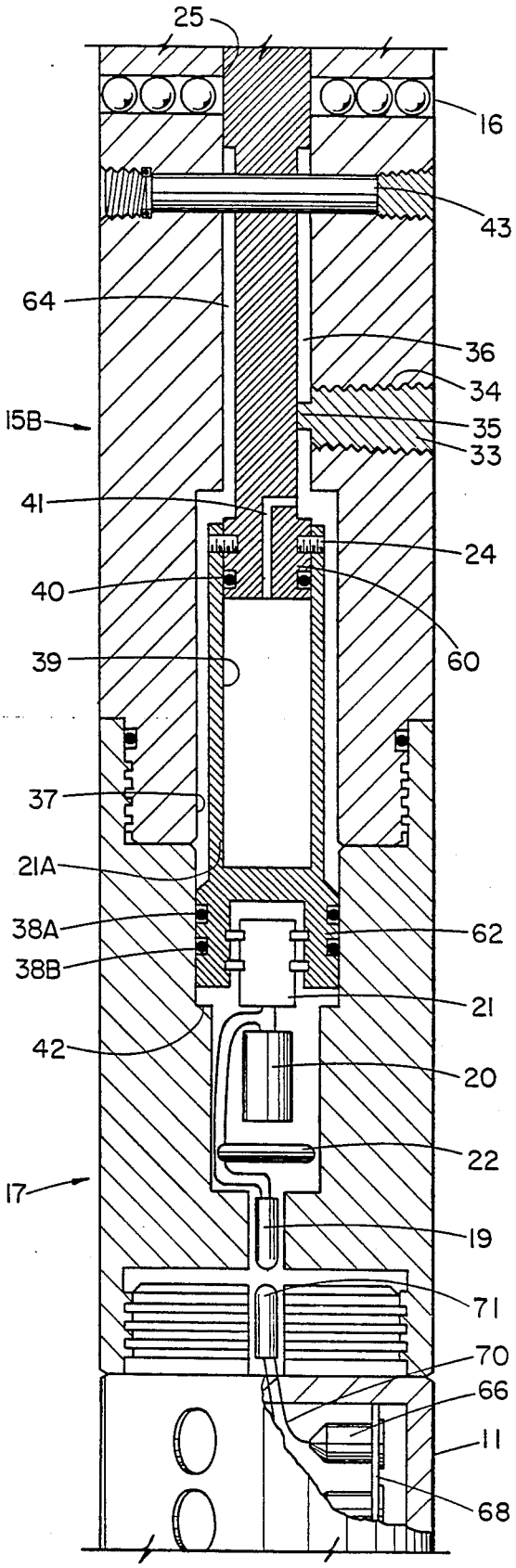

Referring now to FIG. 2A, the gun firing head 18 comprises an initiation device 14 and a gun rotating device 15 having upper housing 15A and lower housing 15B rotatably attached by swivel joint 16. Lower housing 15B is rigidly attached to the firing circuit housing 17, which in turn is attached to the perforating gun section 11. The explosive charges 66 in the perforating gun section 11 can be oriented relative to the firing circuit housing 17 in any desired relationship. Firing circuit housing 17 contains a firing circuit having an electrical detonator 19, power source 20, actuation switch 21 and gravity switch 22. When activated, electric detonator 19 fires into receiver booster 71, which in turn is connected to primacord 70 for detonating the shaped charges 66.

The initiation device 14 shown in FIG. 1A comprises a rupture disk assembly 50 having a disk 51 intended to rupture upon the increase of pressure in tubing 12 above a preselected limit. When disk 51 ruptures, percussion mix 52 will be fired in conventional fashion, which in turn activates powder charge 29. If desired, a conventional time delay charge 44 may be interposed between the percussion mix and the powder charge 29, which delays activation of charge 29 upon initiation of mix 52.

Torque shaft 23 is slidingly and sealingly engaged in cylinder bore 25 of upper housing 15A by O-ring 53. Piston 26 is fixedly positioned on the upper end of shaft 23, and is sealingly engaged in cylinder bore 27 of housing 15A by O-ring 28. The power charge 29 of the type conventionally used in power systems of wireline set packers provides the force required to drive piston 26 downward in cylinder bore 27. Guide pin 30 interlocks the torque shaft 23 with a 360° spiral screw groove 31 cut in sleeve 32, which is fixedly positioned within the housing 15A.

The lower end of torque shaft 23 is provided with a piston 60 which slides within bore 39 of activation switch sleeve 21A and is sealed therewith by O-ring 40. Switch sleeve 21A is attached to torque shaft 23 by shear screw 24, and is housed within bore 37 of lower housing 15B. The lower end of sleeve 21A is provided with piston 62 having seals 38A,38B which seal with bore 37.

Upon explosion of the power charge 29 by the initiating device 14, piston 26 is forced downward in cylinder bore 27. Since the upper housing 15A is rigidly affixed to the hollow conduit 12, rotational torque is imparted to lower housing 15B through torque pin 33 which is held in housing 15B by threads 34. Torque pin 33 has nose portion 35 which is slidingly received in liner torque groove 36, such that as torque shaft 23 moves downward along groove 31 and simultaneously rotates, lower housing 15B will rotate.

Shear pin 43 prevents downward movement of torque shaft 23 and hence switch sleeve 21A until the disk assembly 50 is activated, and thus prevents unintentional firing of the perforating charges while running the gun into the hole and positioning the guns. As the torque shaft 23 moves downward, shear pin 43 initially shears. Thereafter, shear screw 24 will shear when the end of sleeve 21A engages shoulder 42. O-ring 40 serves to seal fluid in cylinder bore 39 and force it through fluid stroke dampening passageway 41 within torque shaft 23.

In practice, initiating device 14 may be activated from the surface by any conventional manner, including the dropping of a go-devil, the use of hydraulic tubing or annulus pressure, or the running of an electric line. When used, time delay 44 allows the well to be underbalanced by breaking a disk (not shown) in the tubing 12 with the go-devil, with the go-devil thereafter continuing downward causing percussion mix 52 to fire. In any event, the initiating device 14 detonates the power charge 29 which forces piston 26 downward along the spiral groove 31. After shear pin 43 has sheared, switch sleeve 21A bottoms against shoulder 42. This movement is sufficient to close the activation switch 21 which connects the power source 20 with the electrical detonator 19 through gravity switch 22. Continued downward movement of torque shaft 23 shears screw 24, allowing the torque shaft 23 to continue its downward movement. As the torque shaft continues moving downward in spiral groove 31, the lower housing 15B is forced to rotate. Since gun sections 11 are rigidly attached to the lower housing 15B, the gun sections and thus the charges 66 likewise rotate.

In order to increase the accuracy and the precision of the angular position of the charges when the gun fires, the orifice passageway 41 is sized to provide a slow descent of the torque shaft 23 into the closed cylinder bore 39, thereby limiting the speed of rotation of the lower section 15B. The volume of annulus 64 between the housing 15B and the combination shaft 23 and sleeve 21A is sufficient to receive the fluid from bore 39 as the piston 60 moves downward. If desired, a check valve (not shown) may be placed in passageway 41 to ensure that bore 39 is full of the incompressible fluid when the initiating device 14 is activated.

The shaped charges 66 housed on gun carrier 68 of gun sections 11 are thus each positioned at a fixed selected rotational position with respect to gravity switch 22. Assuming, for example, that it is desired that the perforating charges fire when they are all aimed in the downward direction, each of the charges 66 may be circumferentially positioned in alignment with the switch 22 when rotated to its actuating position for completing the electrical circuit and thus firing only when aimed downward. If desired, the perforating charges could each be offset a desired angle from the activation position of the switch 22, so that the charges would fire, for example, only when aimed downward at an angle of 20° offset from a vertical plane and to the right side of the vertical plane. Also, different shaped charges may each be positioned at different angular positions with respect to switch 22, so that certain charges are aimed directly downward, other charges are directed downward and to the right at a 20° angle, and other charges are directed downward and to the left at a 20° angle.

Figure 3:
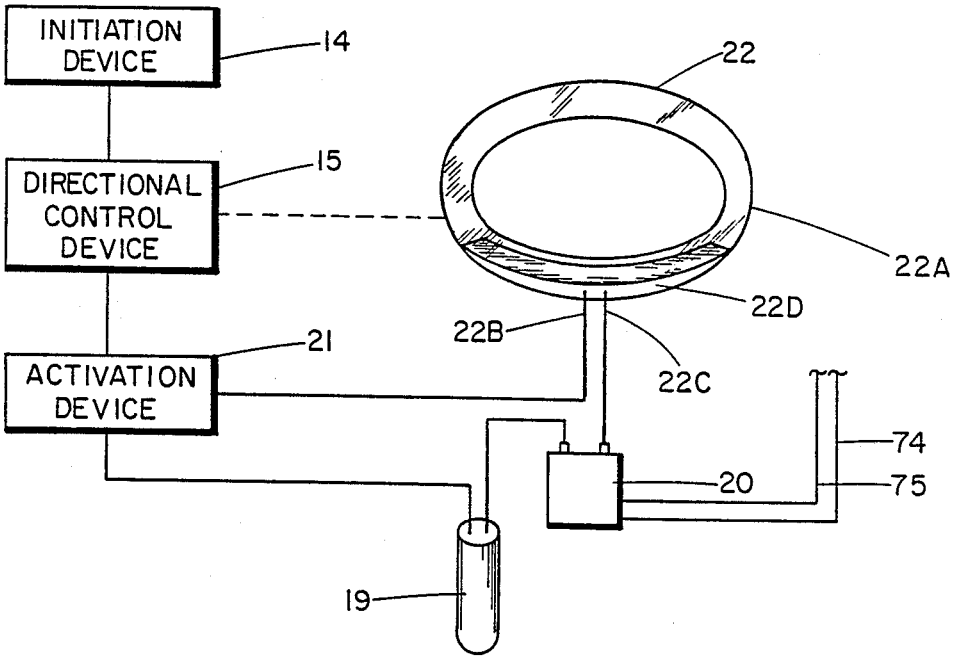
FIG. 3 is a simplified schematic view of the gravity switch and firing circuit.

Referring now to FIG. 3, an enlarged schematical view of the electrical firing circuit is shown. The major components of this circuit include an electric detonator 19, power source 20, activation device or switch 21 and a gravity switch 22. It can be seen that gravity switch 22 consists of a circular vacuum tube 22A containing electrodes 22B and 22C and having a mercury bead trapped inside. Activation switch 21 may be energized to complete the circuit, thereby producing a first electrical signal on both sides of the switch 21, in response to actuation of the initiating device 14. Activation of the initiating device 14 also actuates the gun rotating or directional control device 15, which controls rotation of gravity switch 22. When properly positioned with respect to a vertical plane passing through the center line of the gun, gravity switch 22 may be energized to produce a second electrical signal on both sides of the switch 22, thereby completing the circuit and allowing transmission of the signal from the battery 20 to the detonator 19. Power source 20 may be an electric storage battery of the type typically used in downhole equipment. Electrical conductor lines 74, 75 may be provided from the downhole gun to the surface, and may be used either to maintain a desired charge in the battery 20, or used to transmit the signal directly to 19 to initiate detonation.

Thus detonator 19 can be considered either responsive to the first and second signals from the switches 21 and 22, or responsive to the signal from the battery 20 to detonator 19 upon completion of the circuit by closing of the switches 21,22. Once activation switch 21 has been closed, all that is required to fire the guns is completion of the electrical firing circuit through gravity switch 22. This is accomplished when the mercury bead 22D bridges the gap across electrodes 22B and 22C, which will occur when the gun section 11 and lower housing 15B are rotated as described above.

In another embodiment of the invention, firing of the detonator 19 occurs when a first signal has been transmitted from the surface to the firing head, and when a second signal has been generated indicating that the shaped charges are at their desired rotational position. If a packer is not utilized, the first signal may be generated by dropping a bar through the tubing or by passing a signal down an electric line. The tubing 12 may then be rotated from the surface, thereby rotating the gun and switch 22, until gravity causes mercury in switch 22 to complete the circuit, thereby automatically firing the gun if the first signal has previously been generated.

Figure 4:
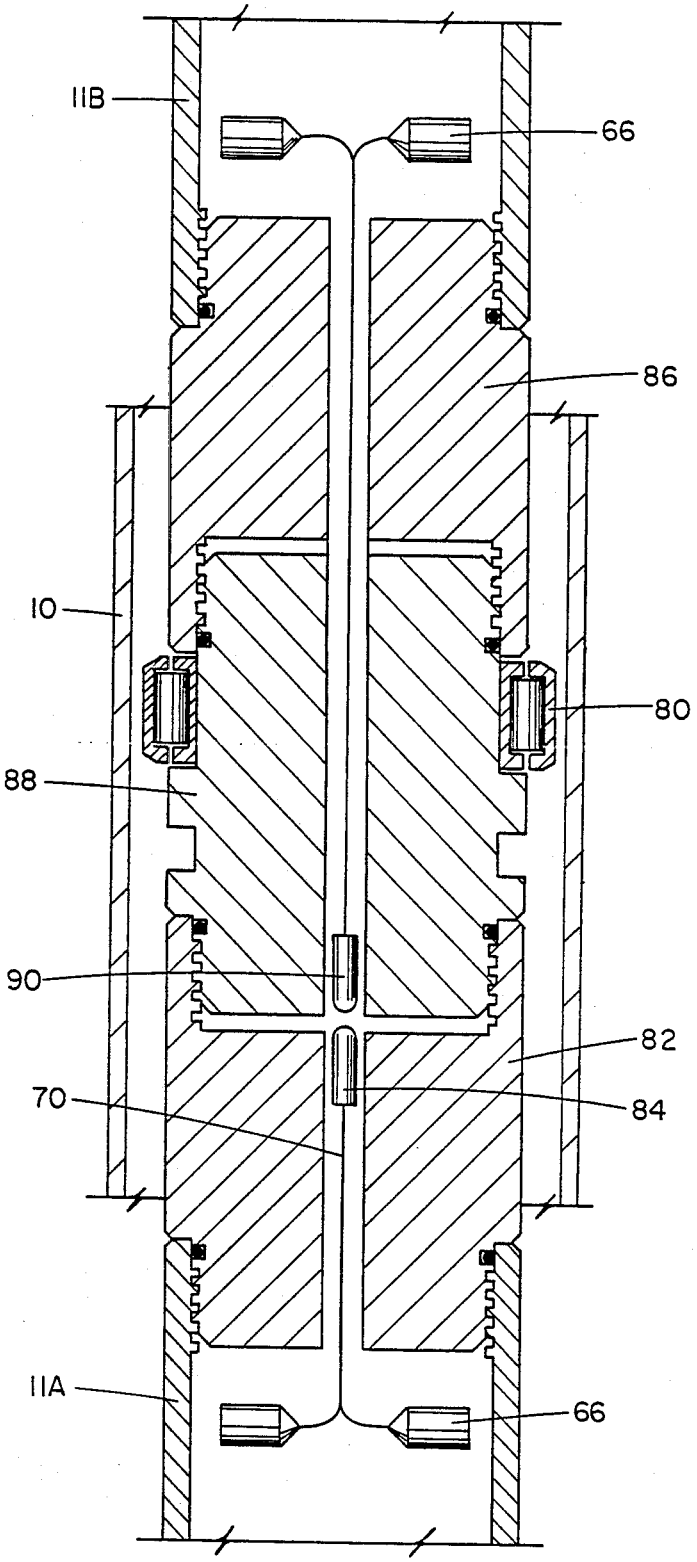
FIG. 4 is a simplified cross-sectional view of adjoining ends of gun sections with a roller bearing for reducing the torque required to rotate the gun.

FIG. 4 illustrates suitable apparatus for both connecting ends of gun sections and for significantly reducing frictional engagement between the rotating gun and the casing. Long gun sections used with the firing techniques described herein may thus be interconnected as shown in FIG. 4 to reduce the torque necessary to rotate the gun, thereby ensuring that the gun is capable of being rotated by the downhole initiation device so that the gun will fire with the charges in the desired position.

Gun sections 11A and 11B are threaded at each end in a conventional manner. Primer cord 70 extends through gun section 11A to fire-shaped charges 66 therein, and continues through gun section 11B to fire similar charges. Roller bearing assembly 80 is provided axially spaced between the gun sections and extends radially outward from the outer surface of either the gun sections 11A or 11B. Accordingly, the roller bearing 80, provides rolling engagement with the casing 10 as the gun rotates and thereby substantially reduces the torque necessary to rotate the gun in the casing.

When shipped to the well site, the end of gun section 11A may have a box-to-pin connector 82 threaded thereto in sealed engagement. A conventional booster 84 may thus be provided in the interior passageway of connector 82, as shown. Similarly, the end of gun section 11B when shipped to the field may be provided with an adapter 86 threaded in sealed engagement to the gun body and pin-to-pin connector 88 threaded in sealed engagement to the adapter. Another booster 90 is provided adjacent booster 84, so that booster 84 detonates booster 90 and thus transmits the detonation signal along the prima cord to the shaped charges.

Roller bearing 80 is thus housed on connector 88 and axially fixed between members 86 and 88 as shown. The gun sections with the connectors previously threaded thereto may be assembled at the well site, so that the central passageway for housing the prima cord remaining sealed from the downhole fluids.

Although the invention has been described in terms of specified embodiments which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention. For example, the firing head may be activated by dropping a bar or other weight through the tubing, or may be fired hydraulically by casing or tubing annulus pressure, or differentials therebetween, or may be fired electrically or sonically, or the like. Additionally, the first signal generating means or switch does not necessarily have to be within the firing head or the gun, or even within or on the conduit carrying these devices into the well. Such means may be provided in the form of a three-phase mercury switch (or three individual switches) at the top of the well and above the upper end of the casing conduit. Electrical alignment of the switch, or similar device, may be used to transmit an electrical or other signal to means, such as a pressure relief device in the guns, which would stop gun rotation at the desired position. A second signal activated by a bar, electrical pulsation, or the like would then fire the guns, as described above. It will also be appreciated that the device and method of the present invention will avoid inadvertent firing of the firing head and gun, since proper directional orientation must be established in order to activate the automatic generation of the activation signal.

What is claimed and desired to be secured by Letters Patent is:

1. A method of orienting a subterranean well perforating gun for perforating casing of the well, said well being deviated from a vertical axis of the well and extending into a formation to be perforated by the perforating gun, said gun having a firing head and a plurality of explosive charges for creating fluid passageways through the casing, the method comprising the steps of:

(a) connecting the firing head in a selected fixed rotational position relative to the explosive charges;

(b) positioning the perforating gun within the casing and in the deviated portion of the well adjacent the formation to be perforated;

(c) generating a first signal in response to an action initiated at the surface for the purpose of establishing rotation of the perforating gun about its central axis; and (d) upon rotation of the perforating gun by means of step (c) to orient the explosive charges at a preselected rotational position relative to a vertical plane passing through the central axis of the perforating gun, automatically generating a second signal in response to such rotation to automatically detonate the explosive charges in response to the first and second signals.

2. A perforating device including a firing head having an exterior housing and a gun having a plurality of explosive charges, the perforating device being positionable at a firing position within a deviated portion of a casing string having an upper and lower ends in a subterranean well, for creating fluid passageways through the casing at both a selected position along an axis of the casing and at a selected rotation relative to a vertical plane passing through a central axis of the perforating gun, the improvement comprising:

first actuation means for generating a first signal when said perforating device is at the selected axial position within the casing;

second actuation means for automatically generating a second signal in response to a predetermined rotational orientation of said explosive charges relative to the vertical plane passing through the central axis of the perforating gun; and detonator means for initiating the detonation of the plurality of explosive charges in response to the first and second signals, such that the charges will fire when said perforating gun is at said desired axial position within said casing and said explosive charges are circumferentially positioned at a predetermined rotational position relative to the vertical plane passing through the central axis of the perforating device.

3. The device of claim 2 wherein the first actuation means is sealingly positioned within the firing head housing.

4. The device of claim 2 wherein the first actuation means is positioned immediate the top of the subterranean well and above the upper end of the casing string.

5. The apparatus of claim 2 wherein the second actuation means is sealingly positioned within the firing head housing at a fixed circumferential position relative to the explosive charges.

6. The apparatus as defined in claim 2, wherein the gun further comprises:

an outer cylindrical-shaped gun body;

a roller member positioned on the gun body and extending radially outward therefrom for rolling engagement with the casing string to reduce torque necessary to rotate the gun within the casing string.

7. A perforating device including a firing head having an exterior housing a gun having a plurality of explosive charges, the perforating device being positionable at a firing position within a deviated portion of a casing string having upper and lower ends in a subterranean well, for creating fluid passageways through the casing at both a selected position along an axis of the casing and at a selected rotation relative to a vertical plane passing through a central axis of the perforating gun, the improvement comprising:

first means for transmitting an actuation signal when said perforating device is at a selected axial position within the casing;

second means for automatically transmitting the actuation signal in response to rotation orientation of said explosive charges relative to the vertical plane passing through the central axis of the perforating gun; and detonator means for initiating the detonation of the explosive charges in response to the actuation signal, such that the charges will fire when said perforating gun is at said desired axial position within said casing and said charges are circumferentially positioned at the predetermined position relative to the vertical plane passing through the central axis of the perforating device.

8. The device of claim 7 wherein the first actuation means is positioned immediate the top of the subterranean well and above the upper end of the casing string.

9. A method of perforating a casing of a subterranean well deviated from a vertical axis of the well and extending into a formation to be perforated by a perforating gun having a firing head and a plurality of explosive charges for creating fluid passageways through the casing, the method comprising the steps of:

(a) connecting the firing head in a selected fixed rotational position relative to the explosive charges;

(b) positioning the perforating gun within the casing and in the deviated portion of the well adjacent the formation to be perforated;

(c) generating a first signal in response to an action initiated at the surface;

(d) rotating the perforating gun about its central axis;

(e) automatically generating a second signal in response to rotation of the gun orienting the explosive charges at a preselected rotational position relative to a vertical plane passing through the central axis of the perforating gun;

(f) automatically detonating the explosive charges in response to said first and second signals.

10. The method as defined in claim 9, wherein the first signal is an electrical signal transmitted within the firing head upon closure of a first switch, and the second signal is an electrical signal transmitted within the firing head upon closure of a second switch.

11. The method as defined in claim 9, wherein the step of rotating the perforating gun comprises rotating a tubular conduit at the surface which is connected to the perforating gun positioned in the well.

12. The method as defined in claim 9, wherein the step of rotating the perforating gun comprises:

providing a swivel within the firing head; and generating downhole a force for rotating the gun relative to casing above the slip joint.

13. The method as defined in claim 12, wherein the step of generating downhole a force comprises:

positioning a piston within an upper portion of the firing head above the swivel;

simultaneously moving the piston axially and rotationally within the upper portion of the firing head;

interconnecting the piston and a lower portion of the firing head such that the lower position of the firing head rotates in response to rotation of the piston; and interconnecting the lower portion of the firing head and the perforating gun.

14. The method as defined in claim 13, further comprising the step of:

controlling the speed at which the perforating gun is rotated about its central axis.

15. The method as defined in claim 12, further comprising:

the gun including a generally cylindrical gun body; and providing a roller member on the gun body and extending radially outward therefrom to reduce the force required to rotate the gun within the casing.

16. The method as defined in claim 9, further comprising the step of:

providing a time delay between initiation of said action of the surface and generation of said first signal sufficient to allow for underbalancing the well.

17. The method as defined in claim 9, further comprising the step of:

setting a packer within the casing above the perforating gun; and maintaining the packer in its set condition while rotating the perforating gun about its central axis.

18. A perforating device including a firing head having an exterior housing and a gun having a plurality of explosive charges, the perforating device being positionable at a firing position within a deviated portion of a casing string of a subterranean well for creating fluid passageways through the casing at both a selected position along an axis of the casing and at a selected rotation relative to a vertical plane passing through a central axis of the perforating gun, the improvement comprising:

first actuation means sealingly positioned within the firing head housing for generating a first electrical signal when said perforating device is at the selected axial position within the casing;

second actuation means sealingly positioned within the firing head housing at a fixed circumferential position relative to the explosive charges for automatically generating a second electric signal in response to a predetermined rotational orientation of said explosive charges relative to the vertical plane passing through the central axis of the perforating gun; and electrical detonator means sealingly positioned within the firing head housing for initiating the detonation of the plurality of explosive charges in response to the first and second signals, such that the shaped charges will fire when said perforating gun is at said desired axial position within said casing and said explosive charges are circumferentially positioned at the predetermined rotational position relative to the vertical plane passing through the central axis of the perforating device.

19. The perforating device as defined in claim 18, further comprising:

power source means for powering the electric detonator means.

20. The perforating device as defined in claim 18, further comprising:

rotating means within the firing head housing and for rotating a lower portion of said firing head and said explosive charges gun independently of an upper portion of said firing head housing.

21. The perforating device as defined in claim 20, wherein the rotating means further comprises:

a piston slidably positioned within a base of the upper housing;

guide means for causing the piston to rotate as it travels axially in the upper housing;

a swivel between the upper position and lower position of the firing head;

a torque shaft interconnected with the piston; and locking means for rotationally interconnecting the torque shaft and the lower portion of the firing head.

22. The perforating device as defined in claim 21, wherein the rotating means further comprises:

dampening means for controlling the rotational velocity of said explosive charges.

23. The perforating device as defined in claim 18, further comprising:

prevention means for maintaining first electric signal generating means in an inoperative position until said actuation means is at a selected axial position within the casing.

24. The perforating device as defined in claim 18, further comprising:

delay means sealingly positioned within the firing head housing for delaying generation of the first electric signal subsequent to an initiating acting from the surface.

25. The perforating device as defined in claim 18, wherein:

the first actuation means is a first electrical switch for transmitting the first signal within the firing head upon actuation of the first switch; and the second actuation means is a second electrical switch for transmitting the second electrical signal within the firing head upon actuation of the second switch.

26. The perforating device as defined in claim 18, wherein the gun further comprises:

an outer cylindrical-shaped gun body;

a roller member positioned on the gun body and extending radially outward therefrom for rolling engagement with the casing string to reduce torque necessary to rotate the gun within the casing string.

27. A perforating device including a firing head having an exterior housing and a gun having a plurality of explosive charges, the perforating device being positionable at a firing position within a deviated portion of a casing string of a subterranean well for creating fluid passageways through the casing at both a selected position along an axis of the casing and at a selected rotation relative to a vertical plane passing through a central axis of the perforating gun, the improvement comprising:

first switch means sealingly positioned within the firing head housing for transmitting an actuation signal when said perforating device is at a selected axial position within the casing;

second switch means sealingly positioned within the firing head housing at a fixed circumferential position relative to the explosive charges for automatically transmitting the actuation signal in response to rotational orientation of said explosive charges relative to the vertical plane passing through the central axis of the perforating gun; and electrical detonator means sealingly positioned within the firing head housing for initiating the detonation of the plurality of explosive charges in response to the actuation signal, such that the shaped charges will fire when said perforating gun is at said desired axial position within said casing and said explosive charges are circumferentially positioned at the predetermined position relative to the vertical plane passing through the central axis of the perforating device; and power source means for powering the electric detonator means.

28. The perforating device as defined in claim 27, further comprising:

rotating means within the firing head housing and for rotating a lower portion of said firing head and said explosive charges gun independently of an upper portion of said firing head housing.

29. The perforating device as defined in claim 28, wherein the rotating means further comprises:

a piston slidably positioned within a base of the upper housing;

guide means for causing the piston to rotate as it travels axially in the upper housing;

a swivel between the upper position and lower position of the firing head;

a torque shaft interconnected with the piston; and locking means for rotationally interconnecting the torque shaft and the lower portion of the firing head.

30. The perforating gun as defined in claim 28, further comprising:

prevention means for maintaining first switch in an inoperative position until said actuation means is at a selected axial position within the casing.

31. A perforating device including a firing head having an exterior housing and a gun having a plurality of explosive charges, the perforating device being positionable at a firing position within a deviated portion of a casing string of a subterranean well for creating fluid passageways through the casing at both a selected position along an axis of the casing and at a selected rotation relative to a vertical plane passing through a central axis of the perforating gun, the improvement comprising:

first switch means for transmitting an actuation signal when said perforating device is at a selected axial position within the casing;

second switch means for automatically transmitting the actuation signal in response to rotational orientation of said explosive charges relative to the vertical plane passing through the central axis of the perforating gun; and electrical detonator means sealingly positioned within the firing head housing for initiating the detonation of the plurality of explosive charges in response to the actuation signal, such that the shaped charges will fire when said perforating gun is at said desired axial position within said casing and said explosive charges are circumferentially positioned at a predetermined position relative to the vertical plane passing through the central axis of the perforating device; and power source means for powering the electric detonator means.

32. A method of orienting a subterranean well perforating gun for perforating casing of the well, said well being deviated from a vertical axis of the well and extending into a formation to be perforated by the perforating gun, said gun having a firing head and a plurality of explosive charges for creating fluid passageways through the casing, the method comprising the steps of:

(a) connecting the firing head in a selected fixed rotational position relative to the explosive charges;

(b) positioning the perforating gun within the casing and on the deviated portion of the well adjacent the formation to be perforated; and (c) generating a first signal in response to an action initiated at the surface for the purpose of establishing rotation of the perforating gun about its central axis.

* * * * *